US005913316A

United States Patent [19]

Chou

[11] Patent Number: 5,913,316

[45] Date of Patent: Jun. 22, 1999

[54] BARRETTE

[76] Inventor: Chi-Hsiung Chou, P.O. Box 90, Tainan City, Taiwan

[21] Appl. No.: 09/226,137

[22] Filed: Jan. 5, 1999

[51] Int. Cl.[6] ..... A45D 8/12; A45D 8/22; A45D 8/04

[52] U.S. Cl. ..... 132/275; 132/278; 132/273

[58] Field of Search ..... 132/275, 273, 132/276, 277, 278, 279; D28/33, 41

[56] References Cited

U.S. PATENT DOCUMENTS 5,829,457 11/1998 Huang ..... 132/275

*Primary Examiner*—John J. Wilson
*Assistant Examiner*—Trang Doan

[57] ABSTRACT

A barrette includes a main body and a decorative member. The main body has a plurality of sidewise projections spaced apart and extending from two lengthwise sides, an elongate recess in the intermediate portion with a hole respectively formed at the two sides and with a stop edge formed at an inner side, as well as a recess and a groove respectively formed at two opposite sides. Two stop blocks and two projections are provided on the decorative member with a stop member resectively at two opposite ends to engage the stop edges and the grooves of main body. The two stop members made to pass through the holes engage the recesses of the main body. The projections engage the grooves of th main body to secure the decorative member rest on the main body. Then the barrette is bent to curve and worn on the hairs of a person.

8 Claims, 7 Drawing Sheets

BARRETTE

BACKGROUND OF THE INVENTION

This invention relates to a barrette, particularly to one consisting of a main body and a decorative member combined on the main body. The main body has an elongate recess in the intermediate portion. Two holes and two recesses are formed at two opposite ends of the main body. The decorative member has two stop members to engage the two recesses of the main body, two stop blocks and two projections to engage two stop edges and two grooves of the main body so that the decorative member is secured in the elongate recess of the main body and the barrette may be bent to curve to be worn on the hairs of a person. Then many decorative members can be alternately combined with the main body.

Common conventional barrettes generally include an elastic plastic plate of a single color, and if it is wanted to have a variety, a number of barrettes of different colors or designs should be prepared and alternately used for wearing. Then a user has to spend much more money for them, even if they are not so expensive.

SUMMARY OF THE INVENTION

This invention has been devised to offer a barrette changeable of its decorative member to be combined on a main body so as to use the barrette with different colors and designs alternately at one time.

The main feature of the invention is a main body and a decorative member separably combined on the main body. The main body has an elongate recess in the intermediate portion, a plurality of sidewise projections extending from two lengthwise sides of the elongate recess, and a hole formed at two opposite ends for two stop members of the decorative member to fit through and engage two recesses of the main body, and a stop block formed on a lower surface of the decorative member to engage a stop edge of each hole of the main body so that the decorative member may be secured after combined with the main body.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
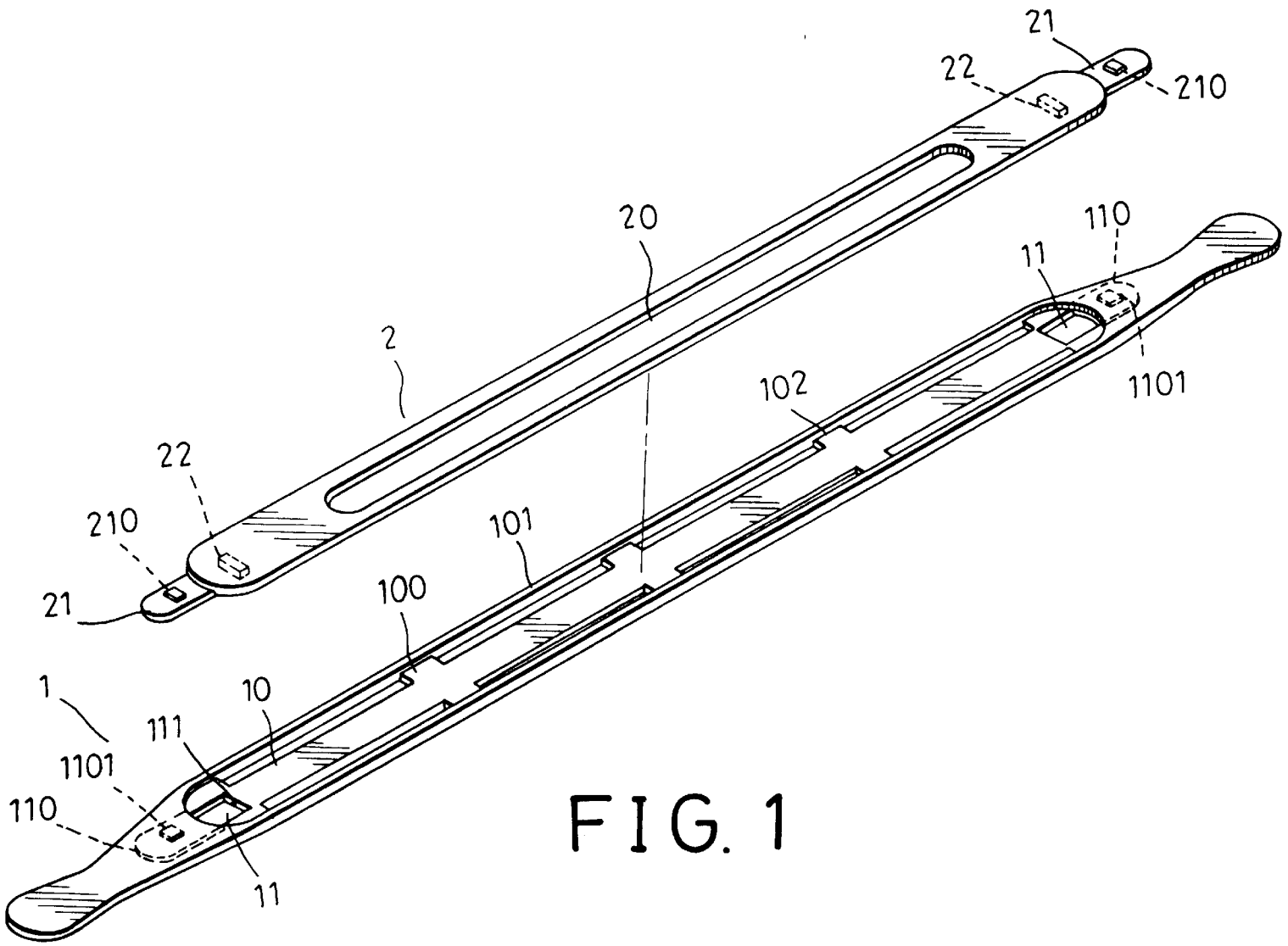
FIG. 1 is an exploded perspective view of a first embodiment of a barrette in the present invention.
Figure 2:
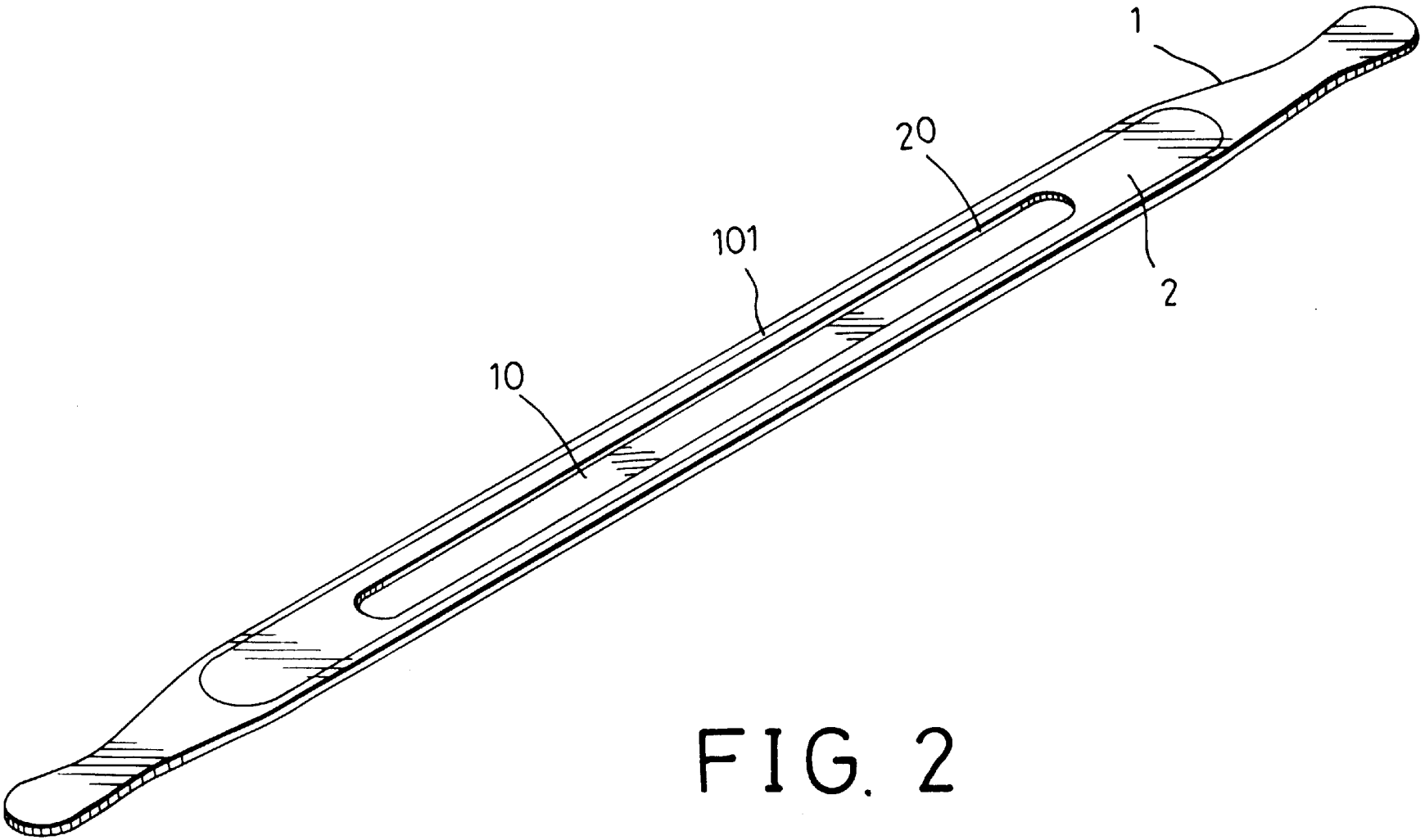
FIG. 2 is a perspective view of the first embodiment of a barrette in the present invention.

A first preferred embodiment of a barrette in the present invention, as shown in FIG. 1, includes a main body 1 and a decorative member 2 separably combined on the main body 1.

The main body 1 has an elongate recess 10 formed in an intermediate portion, decorative designs formed on an upper surface of the elongate recess 10, a plurality of sidewise projections 100 spaced apart and extending from two lengthwise sides of the elongate recess 10, a protective wall 101 formed respectively along the two lengthwise sides of the elongate recess 10, a support edge 102 formed between each sidewise projection 100 and the protective wall 101. Further, a hole 11 is respectively formed between the elongate recess 10 and the two opposite ends, and a recess 110 is respectively formed in a lower side of the two opposite ends, a groove 1101 formed in each recess 110, and a stop edge 111 formed at an inner side of each hole 11.

The decorative member 2 is combined with the main body 1 fitting in the elongate recess 10, having a long aperture 20 in the intermediate portion to locate on the decorated upper surface of the elongate recess 10 of the main body 1, a stop member 21 formed respectively in two opposite ends of the same shape and size of the recess 110 of the main body 1, a projection 210 formed on each stop member 21 to fit in the groove 1101 of the main body 1, and a stop block 22 formed respectively under two sides of a bottom side to engage the stop edge 111 of the hole 11 of the main body 1.

Figure 4:
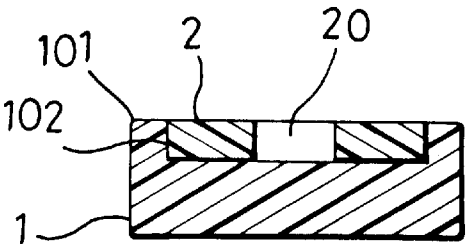
FIG. 4 is a side cross-sectional view of the first embodiment of a barrette in the present invention.
Figure 3:
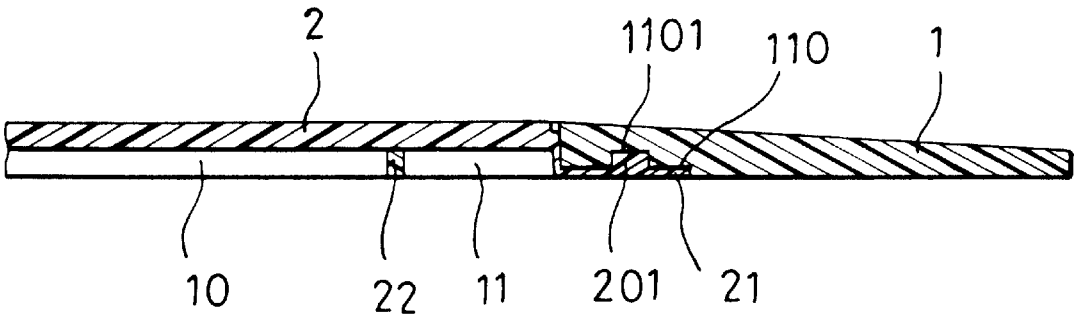
FIG. 3 is a cross-sectional view of the first embodiment of a barrette in the present invention.
Figure 5:
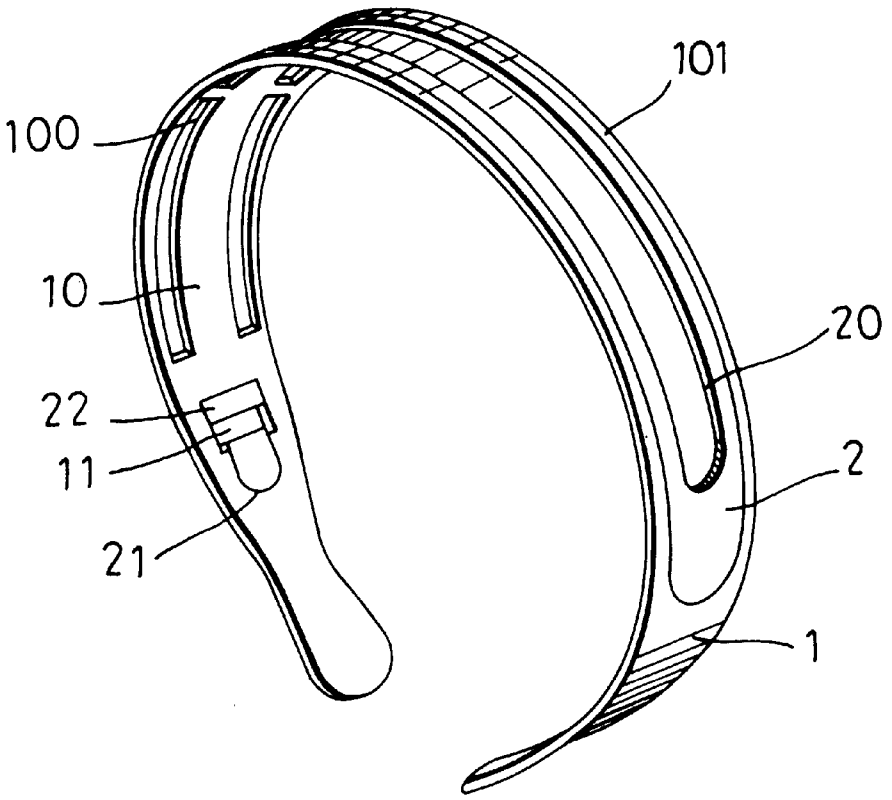
FIG. 5 is a perspective view of the first embodiment of a barrette kept in a curved condition in the present invention.

In wearing this barrette, as shown in FIGS. 1 to 5, the stop members 21 of the decorative member 2 are made to fit through the two holes 11 of the main body 1, with the stop members 21 fitting in the recesses 110, and with the projections 210 engaging the grooves 1101 as shown in FIG. 3. Then the decorative member 2 has the two side lengthwise edges contacting the support edges 102 of the main body 1 as shown in FIG. 4 and protected by the protective walls 101, with the long aperture 20 facing the decorative design on the elongate recess 10. After the barrette is combined together as just described, then it is bent to curve as shown in FIG. 5, the stop blocks 22 engaging the stop edges 111 of the holes 11 and with the projections 210 engaging the grooves 1101, keeping the barrette in the curved shape stabilized as shown in FIG. 5 for wearing on the hairs of a person.

Figure 6:
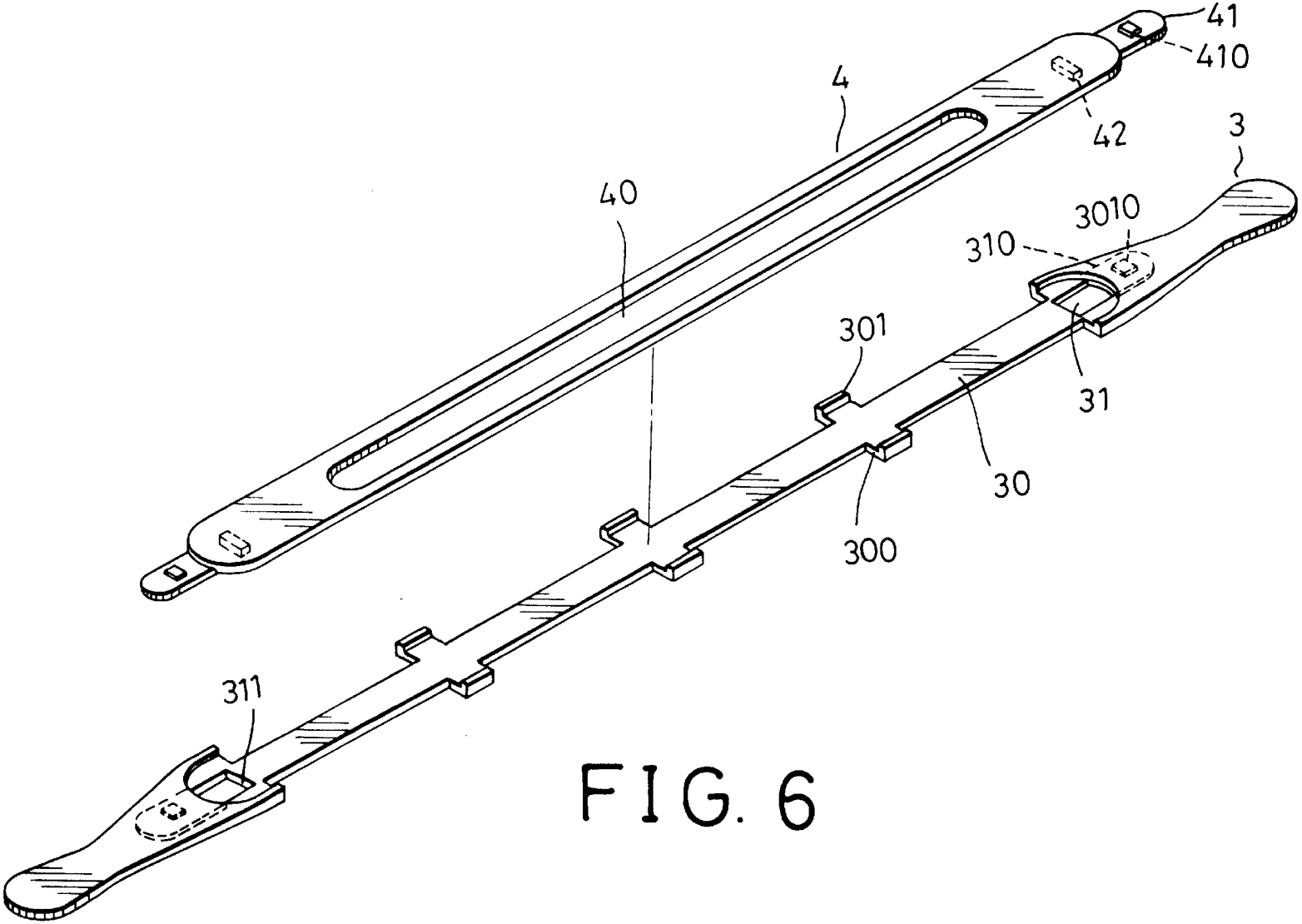
FIG. 6 is an exploded perspective view of a second embodiment of a barrette in the present invention.
Figure 7:
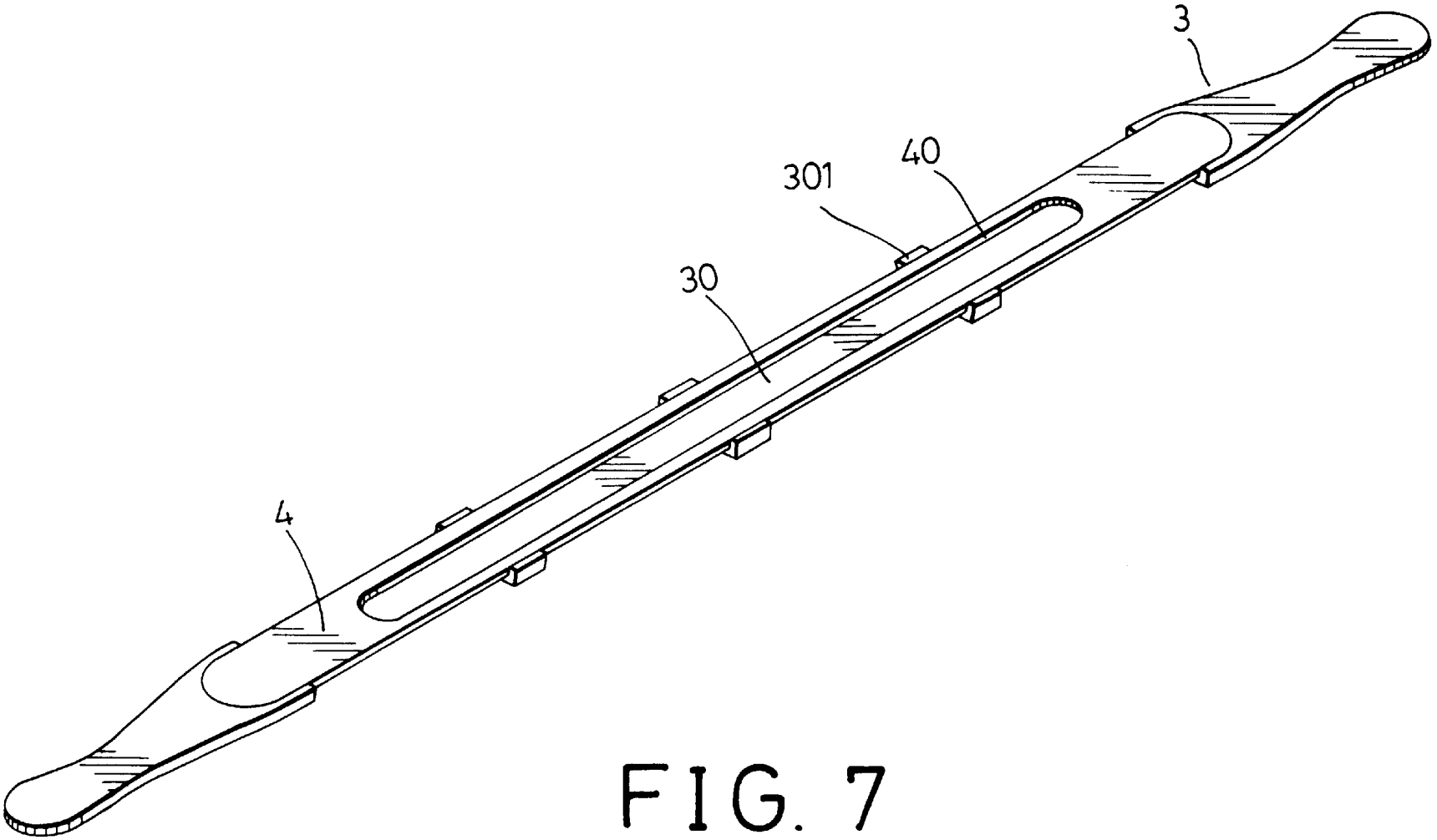
FIG. 7 is a perspective view of the second embodiment of a barrette in the present invention; and, FIG. 8 is a side cross-sectional view of a third embodiment of a barrette in the present invention.

A second preferred embodiment of a barrette in the present invention is shown in FIGS. 6 and 7, includes a main body 3 and a decorative member 4 combined on the main body 3.

The main body 3 has an elongate recess 30 on an upper surface of the intermediate portion, a decorative design formed on the upper surface of the elongate recess 30, a sidewise projection 300 respectively spaced apart and extending sidewise from the two lengthwise sides of the elongate recess 30, and a short support wall 301 formed at the outer edge of each sidewise projection 300. Further, the main body 3 is provided with a hole at two opposite ends, a recess 310 formed in a lower side of the two opposite ends, a groove 3101 provided in the recess 310, and each hole 31 having a inner stop edge 311.

The decorative member 4 is combined with the main body 3 fitting in the elongate recess 30, having a long aperture 40 located on the decorative design of the elongate recess 30, a stop member 41 formed respectively in two opposite ends having the same shape and size as the recess 310 of the main body 3, a projection 410 respectively formed on the stop member 41 to engage the groove 3101 of the main body 3, and a stop block 42 formed under the section between the long aperture 40 and the stop member 41.

In assembling the second embodiment of a barrette, as shown in FIGS. 6 and 7, the two stop members 21 of the decorative member 4 are made to pass through the holes 31 of the main body 3, and engage the recesses 310, with the projections 410 engaging the grooves 3101, letting the decorative member 4 resting on the elongate recess 30, with the side projections 300 and the support walls 301 securing the decorative member 4. Then the long aperture 40 just faces the decorative design of the elongate recess 30. After the barrette is assembled together, it is bent to curve, with the stop blocks 42 engage the stop edges 311 of the holes 31.

Figure 8:
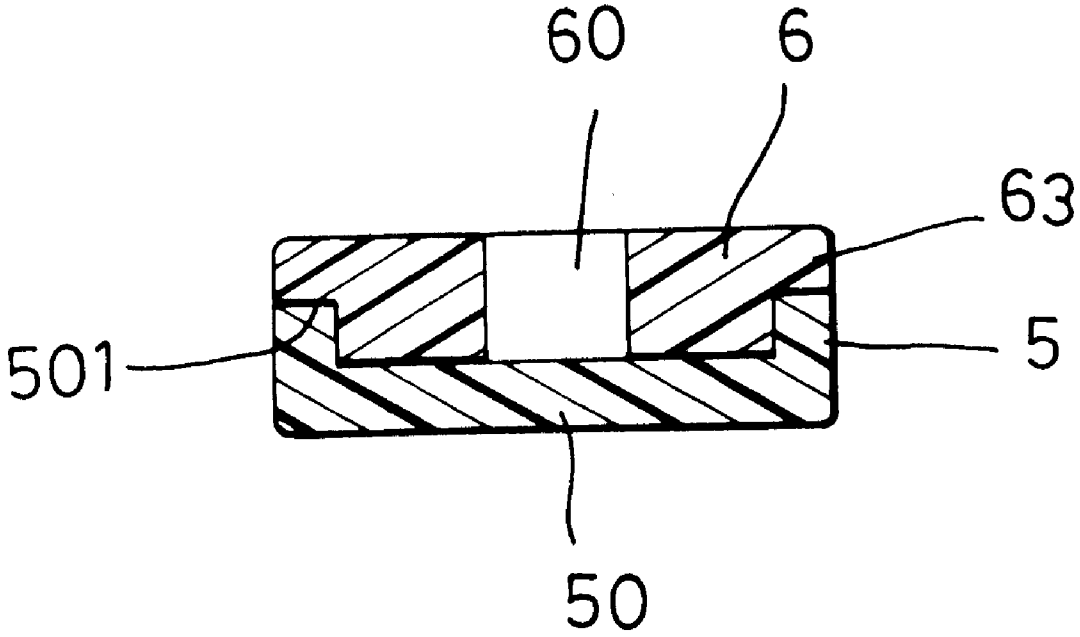

A third preferred embodiment of a barrette is shown in FIG. 8, includes a main body 5 and a decorative member 6 having the same structure as the second embodiment, except that the decorative member 6 is provided with a plurality of lengthwise side edges 63 to rest on the support walls 301 of the elongate recess 50 of the main body 5. So in assembling, the lengthwise side edges 63 rest on the support walls 301, with the other parts being the same as the second embodiment.

Further, the main body and the decorative member may be made of different materials, and the upper surface of the long recess of the main body may have various decorative designs so that many decorative members may be changed alternately for supplying the barrette with various appearances.

While the preferred embodiments of the invention have been described above, it will be recognized and understood that various modifications may be made therein and the appended claims are intended to cover all such modifications which may fall within the spirit and scope of the invention.

What is claimed is:

1. A barrette comprising:

a main body having an elongate recess formed in an intermediate portion, said elongate recess having a plurality of sidewise projections spaced apart and extending sidewise from two lengthwise sides, a hole formed respectively in two opposite ends, a recess formed respectively in a lower side of said two opposite ends, a stop edge formed at an inner side of each said hole;

a decorative member combined on said main body fitting in said elongate recess, having a stop member respectively formed at two opposite ends and having the same shape and size as each said recess at the two opposite ends of said main body, a stop block formed on an upper surface behind each said stop member;

said two stop members of said decorative member passing through said two holes of said main body and engaging said two recesses of said main body, permitting said decorative member resting on said elongate recess of said main body and supported by said sidewise projections of said elongate recess, said barrette bent to curve after assembled, with said stop blocks engaging said stop edges of said holes of said main body to secure said decorative member stabilized with said main body and not to fall off said main body.

2. The barrette as claimed in claim 1, wherein said elongate recess of said main body has a decorative design on its upper surface.

3. The barrette as claimed in claim 1, wherein said main body has a lengthwise side wall respectively at an outer side of said sidewise projections, and a support edge is formed between said side lengthwise wall and each said sidewise projection.

4. The barrette as claimed in claim 1, wherein said two side recesses have a groove in a proper location.

5. The barrette as claimed in claim 1, wherein said decorative member has a long aperture facing said decorative design of said long recess of said main body.

6. The barrette as claimed in claim 1, wherein said stop members of said decorative member have a projection to engage each said groove of said main body.

7. A barrette comprising:

a main body having an elongate recess in an intermediate portion, said elongate recess having a plurality of sidewise projections spaced apart and extending outward, each said projection having a short support wall at an outer edge, a hole formed respectively at two opposite ends of said elongate receess, a recess formed respectively in said two opposite ends, a groove formed in each said recess, each said hole having a stop edge at an inner side;

a decorative member combined with said main body resting in said elongate recess, having a stop member formed at two opposite ends and having the same shape and size of said two recesses of said main body, each said stop member provided with a projection to engage said groove of said main body, and two opposite stop block formed on a lower surface and engaging said two stop edges of said holes of said main body.

8. A barrette comprising:

a main body having an elongate recess in an intermediate portion, said elongate recess provided with a plurality of side projections spaced apart and extending from two lengthwise sides, each said projection having a short wall at an outer edge, a hole respectively formed at two opposite sides of said elongate recess, a recess respectively formed in a lower surface of two opposite ends of said main body, a groove respectively formed in each said recess, and a stop edge formed at an inner side of each said hole;

a decorative member combined with said main body resting on said elongate recess, having a stop member respectively formed at two opposite ends and having the the same shape and size as said two recesses of said main body, a projection respectively formed in said stop members to engage said grooves of said recesses of said main body, a stop block respectively formed on a lower surface of two opposite ends and engaging said stop edges of said main body, and a plurality of side projections extending from two lengthwise sides and resting on said short walls of said elongate recess of said main body.

* * * * *